US005323760A

United States Patent [19]

Johnson

[11] Patent Number: 5,323,760

[45] Date of Patent: Jun. 28, 1994

[54] VACUUM WOOD STOVE APPARATUS AND METHOD

[76] Inventor: Christopher J. Johnson, 25230 NE. 52nd, Redmond, Wash. 98053

[21] Appl. No.: 26,523

[22] Filed: Mar. 4, 1993

[51] Int. Cl.[5] ..... F23J 1/00

[52] U.S. Cl. ..... 126/242; 126/245; 126/58; 110/165 R

[58] Field of Search ..... 126/242, 245, 243, 244, 126/152 R, 58; 110/165 R, 165 A, 166; 15/349, 352, 357, 319

[56] References Cited

U.S. PATENT DOCUMENTS

| | | | |
|---|---|---|---|
| 2,529,965 | 11/1950 | Rentz | 126/242 |
| 3,416,514 | 12/1968 | Klemme | 126/242 |
| 4,416,252 | 11/1983 | Blank, Jr. | 126/242 |
| 4,497,308 | 2/1985 | Johnson | 126/242 |
| 4,807,590 | 2/1989 | Evans | 126/242 |
| 4,868,949 | 9/1989 | Loveless et al. | 15/352 |

OTHER PUBLICATIONS

Pyro Industries, Inc., *Advantage Pellet Stove Owner's Manual and Operating Instruction;* pp. 1-36 (no date).

Love Less Ash, *Ash Removal Systems* brochure; p. 1 (no date).

*Primary Examiner*—Larry Jones

*Attorney, Agent, or Firm*—Seed & Berry

[57] ABSTRACT

The present invention relates to a vacuum apparatus in combination with a stove for burning combustible materials, such as cordwood or wood pellets, comprising a combustion chamber in which the material is burned, a stove housing separate but operatively connected to the combustion chamber, and a vacuum apparatus located in the stove housing. The vacuum apparatus comprised of a motor, a housing, a seal plate, a cover plate, a bag cage, vacuum bag, and a hose is used to remove ash, debris, and other combusted material residue from the combustion chamber, thereby maintaining the stove in a clean condition. A vacuum hose installed in the vacuum apparatus transports the combusted material residue from the combustion chamber and surrounding areas into a vacuum bag in the vacuum apparatus. A method for installing a vacuum is also disclosed.

13 Claims, 3 Drawing Sheets

147
146
140
165
40
142
137
152
136
167
135
155
100
160
102
37
112
105
110
168
170
117
127
52
130
70
120
50

10
120
115
125
85
82
95
80
90
87
49
72
67
65
48
62
47
60
38
54
56
21
45
44

167
135
170
152
150
168

VACUUM WOOD STOVE APPARATUS AND METHOD

DESCRIPTION

1. Technical Field

The subject invention relates to a stove for burning combustible materials in combination with vacuum apparatus and an installation method, and more particularly, to a wood-burning stove with a vacuum unit integral to the stove's housing structure.

2. Background of the Invention

People today have many choices on how to heat their homes. As the world's supply of precious oil and natural gas dwindles, the cost of these fossil fuels increase. Due to rising costs and an increased concern for our environment, many people are turning to wood-burning stoves as their source of heat. Cordwood and processed wood pellets provide a very clean, efficient, and renewable source of heat. In fact, the Environmental Protection Agency has recognized wood-burning stoves as a clean burning and environmentally sound source of heat for a home.

A clean, certified pellet-burning stove burning pellets with a low ash content can achieve over 95 percent efficiency while releasing virtually no smoke into the atmosphere. This efficient burn process produces a substantially reduced amount of combusted material While a clean wood-burning stove is very efficient, a stove with ash and deposit buildup will burn fuel with a dramatically lower efficiency. In addition, a dirty stove with this lower efficiency releases more smoke into the atmosphere, requires more fuel to generate the same amount of heat, and results in greater amounts of ash and other combusted material.

A dirty pellet stove also loses efficiency due to clinkering. Some wood pellet fuels contain silica and other impurities which, when burned, form a hard mass of silica. This formation, known as clinkering, is a function of the fuel, and it adversely impacts the performance of the stove by blocking air holes in the burn pot. It is important to the wood-burning stove's efficiency to remove the ash and clinkers from the burn pot's air holes.

Accordingly, wood-pellet stove manufacturers recommend regular cleaning and inspection of the burn pot, heat exchanger tubes, ash pan, and baffles. Such a cleaning operation may be very messy and difficult without the proper equipment. Many people use a large and cumbersome vacuum cleaners, such as a SHOP-VAC to vacuum out and contain the built-up ash and debris from the stove. SHOP-VACS, however, typically require the operator to transport the unit to the stove, find the proper attachments (usually located somewhere other than with the SHOP-VAC), and assemble the vacuum apparatus before beginning the cleaning operation. Many stove owners do not take the sufficient time and expend the required effort to keep their stoves clean enough to burn at the top efficiency. Accordingly, it is an object of the subject invention to provide a novel combination of a wood-burning stove with an integrally mounted vacuum system in the stove's housing.

It is another object of the subject invention to provide a vacuum apparatus within a wood-burning stove housing to facilitate the required cleaning of the stove.

It is yet another object of the present invention to provide a self-contained vacuum system in a stove pedestal of a wood-burning stove.

It is a further object of the present invention to provide a method of installing a vacuum apparatus into a stove pedestal located below and supporting a combustion chamber of a wood-burning stove unit.

SUMMARY OF THE INVENTION

In accordance with these and many other objects, the subject invention provides a vacuum apparatus in combination with a stove for burning combustible materials. The stove includes a combustion chamber joined to a stove housing and the vacuum apparatus is attached to the housing and used to clean the combustion chamber.

In one embodiment of the subject invention, the vacuum is sized and shaped such that the front face of the vacuum housing is integral to or flush with the stove housing. The remaining body of the vacuum housing and associated vacuum motor is disposed within the stove housing and, thus, is not visible when properly installed. The vacuum apparatus includes an orifice shaped to receive a vacuum hose and an internal removeable vacuum bag cage.

Once the stove is installed, the stove owner may insert a vacuum hose into the vacuum apparatus, activate the vacuum motor, and proceed to clean the wood stove (e.g., sucking up additional ash and debris from the ash pan area, the burn pot, the heat exchanger tubes and baffles). The vacuum may further be used to clean up any additional ash or debris within the stove housing, the cooled combustion chamber, or any other area around the stove unit within reach of the vacuum hose.

Further objects and advantages of the subject invention will become apparent from the following detailed description of the preferred embodiment, taken in conjunction with the drawings.

DETAILED DESCRIPTION OF THE INVENTION

Figure 1:
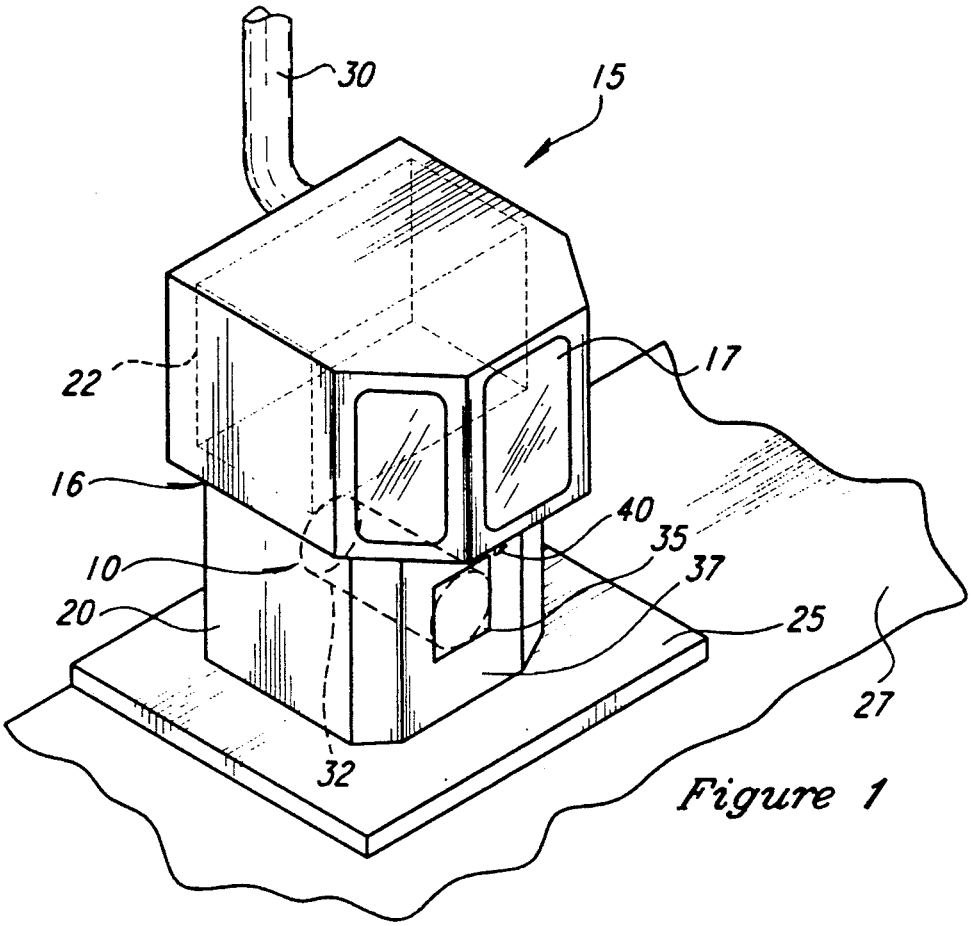
FIG. 1 is a perspective view of a wood-burning stove mounted on a pedestal with the vacuum apparatus installed in the pedestal.

As seen in FIG. 1, a vacuum apparatus 10 is shown in combination with a stove 15 used for burning combustible materials, such as cordwood or wood pellets. The stove comprises a combustion chamber 17 joined to a separate stove housing 16. In the preferred embodiment, the stove housing comprises a pedestal located below the combustion chamber. The pedestal supports the combustion chamber and a conventional hopper and feed auger system 22 that contains wood pellets before they are fed at a predetermined rate into the combustion chamber.

The stove 15 mounts on a footing 25, such as a non-combustible hearth pad, which attaches to the floor 27. The stove further comprises an exhaust flue 30 coupled to the combustion chamber 17 which exhausts the emissions and other gases from the fire to the outside air.

The vacuum apparatus 10 mounts in the pedestal 20, such that the vacuum apparatus is substantially within the pedestal. The vacuum's front cover 35 communicates with a pedestal front panel 37. A vacuum activation switch 40, which could be installed in many places, mounts to the front panel, thereby allowing easy access to the switch by the operator.

Figure 2:
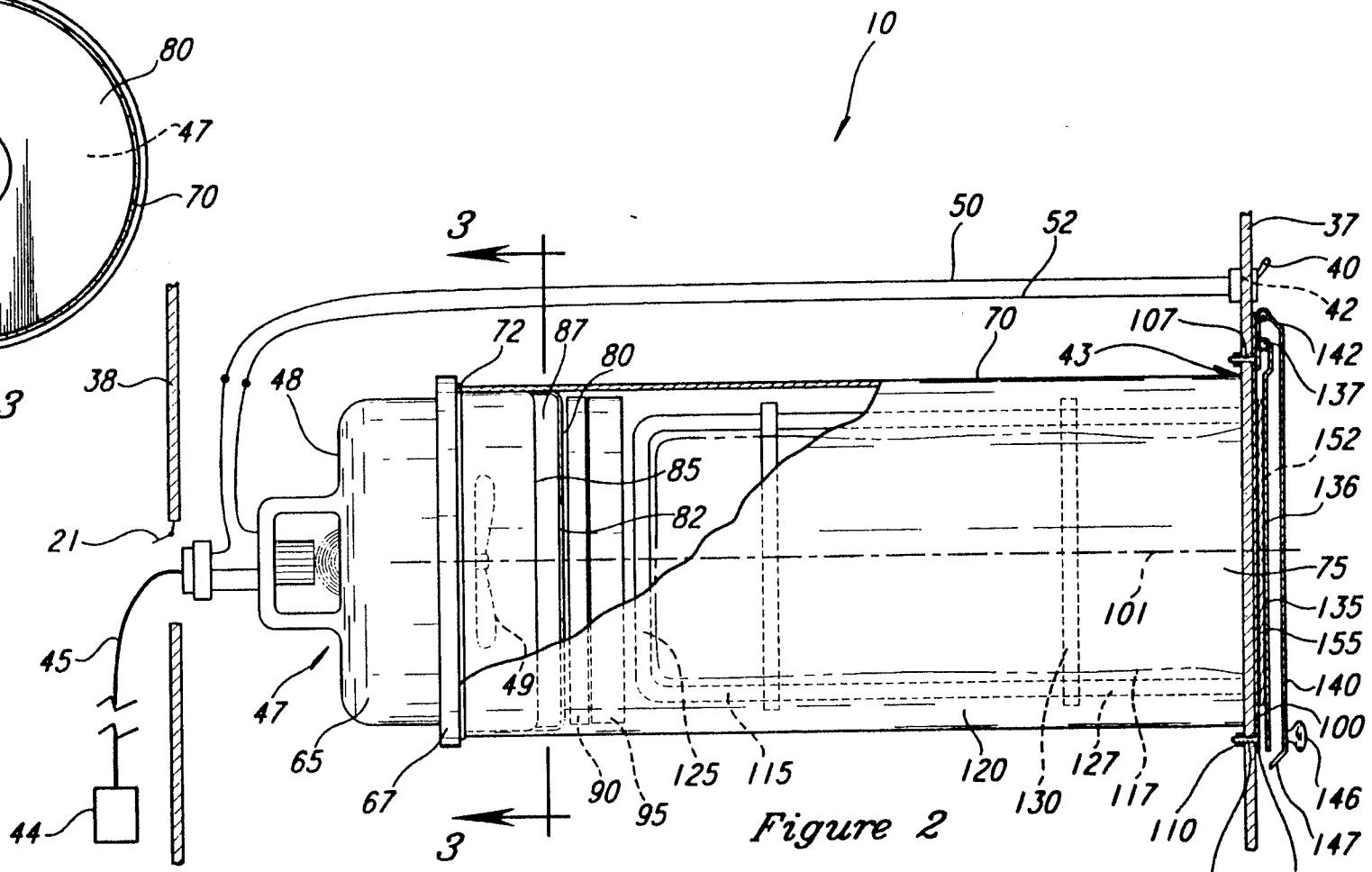
FIG. 2 is a top view of the vacuum apparatus installed in a stove housing.

As seen in FIG. 2, switch 40 is installed through an axial bore 42 in the front panel 37. In the preferred embodiment, the switch comprises a standard on/off switch requiring a bore in the front panel.

Switch 40 is coupled to a power source 44 by an electric cord 45 and to a conventional vacuum motor 47 with an integral vacuum fan 49 by electrical wires 50 and 52. The electric cord extends from the power source into the pedestal 20 through an orifice 21 in the back panel 38 of the pedestal. Thus, the electric cord and switch provide power to the vacuum motor 47.

Figure 3:
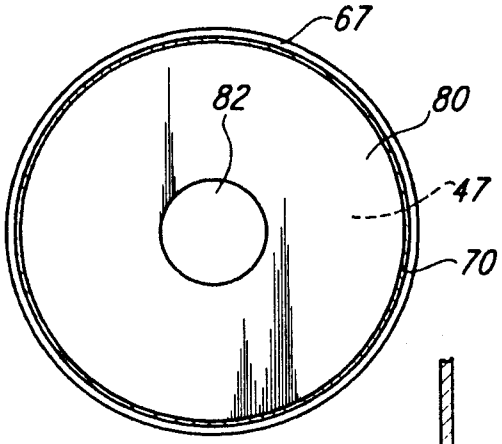
FIG. 3 is a cross-sectional front view along line 3—3 showing the intersection between the vacuum motor and vacuum housing.

Vacuum motor 47 mounts into a vacuum housing 70. In the preferred embodiment, the vacuum motor is a 1½ horsepower, single-stage, AMETEK motor. As seen in FIGS. 2 and 3, the motor has a cylindrical motor housing that press fits into the similarly shaped cylindrical vacuum housing of vacuum apparatus 10. The motor housing further includes a stop ring 67 that communicates with the vacuum housing to prevent the vacuum motor from sliding too far into the vacuum housing. A seal 72 is provided between stop ring 67 and the vacuum housing to prevent air from entering the vacuum housing from the back end and diminishing the vacuum's drawing capacity.

Upon activating motor 47, the motor's fan 49 draws air from the vacuum housing 70 through an intake area 85 of motor housing 65 and exhausts the air out the motor's back end 48. The preferred vacuum motor 47 includes a vacuum housing plate 80 with a bore 82 therein through which air flows prior to entering the intake area 85. The vacuum housing plate is positioned in from the intake area, thereby creating a gap 87. The bore and gap allow sufficient air to reach the motor's intake area, thereby maintaining sufficient draw by the vacuum motor.

A screen 90 is located within the vacuum housing 70 adjacent to the vacuum housing plate 80 in order to prevent debris from being sucked into the vacuum motor 47. An air filter 95 of the porous plastic foam type may be installed within the vacuum housing adjacent to the screen to filter air as it flows from the vacuum housing to the motor. Although the screen and air filter may take any desired shape, the preferred embodiment utilizes a circular screen and filter having diameters corresponding to the inner diameter of vacuum housing. The screen and air filter are removable and should periodically be taken out of the vacuum housing and either replaced or cleaned of excess debris.

Vacuum housing 70 in the preferred embodiment comprises an aluminum cylindrical tube. The vacuum housing may vary in the longitudinal dimension to accommodate different wood-burning stoves available on the market. The vacuum housing further comprises a housing flange 100 around the housing's open end 75 and is perpendicularly disposed to the longitudinal axis 101 of the cylindrical vacuum housing. The preferred housing flange 100 comprises a rectangular shape.

Housing flange 100 further includes a plurality of axial bores 102 shaped to receive fasteners 105 used to fasten the vacuum housing 70 to the pedestal front panel 37. The axial bores are machined into each corner of the housing flange 100 in a manner resulting in a countersunk hole. The fasteners have tapered heads that, when installed in the axial bores, are flush with the housing flange. The fasteners secure the vacuum apparatus 10 in pedestal 20. Axial bores 107 in front panel 37 are provided to correspond with the axial bores 102 in housing flange 100. Accordingly, the fasteners fit through axial bore 102 in housing flange 100, through the axial bore 107 in the pedestal front panel 37, and are secured in place with nuts. In the preferred embodiment, the fasteners are threaded and screw into nuts 110 spot welded to the back face 112 of the pedestal front panel.

A cage 115, shaped to receive a vacuum bag 117, fits into vacuum housing 70. The cage provides support to the vacuum bag while maintaining a sufficient air gap 120 between the bag and the vacuum housing. This gap enables sufficient air to be drawn through the bag by the vacuum motor 47.

In the preferred embodiment, the vacuum bag cage 115 comprises a plurality of strips interconnected to form a back section 125 perpendicular to the housing's longitudinal axis 101, side sections 127 parallel to longitudinal axis 101, and circular strips 130 disposed around the side sections. The circular strips are interconnected such that at least a ½ inch air gap 120 is maintained around the vacuum bag within the cage during operation. For ease of installation, the cage may be removed from the vacuum housing 70 as needed. For example, to remove a filled vacuum bag and install a new, empty vacuum bag.

Figure 4:
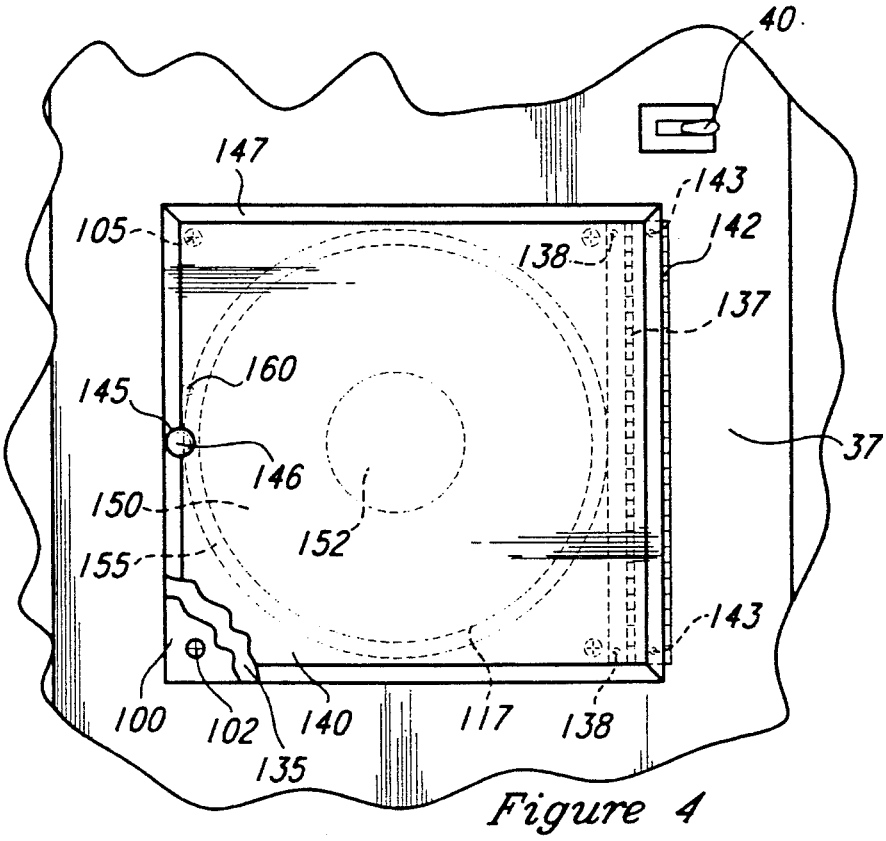
FIG. 4 is a front view of the vacuum apparatus with the decorative door in the closed position.

Referring now to FIGS. 2 and 4, the vacuum apparatus 10 has a seal plate 135 coupled to the vacuum housing 70 and a cover plate 140 coupled to the vacuum housing and shaped to cover the seal plate. The seal plate 135 attaches to a seal plate hinge 137 coupled to housing flange 100. The seal plate hinge is attached to the housing flange with fasteners 138, such as spot welds or threaded fasteners. Thus, the seal plate may pivot about the hinge between a closed position and an open position, as described below. An orifice 136 in seal plate 135 is shaped to receive the tapered nozzle 167 of vacuum hose 165. In the preferred embodiment, the orifice 136 is coaxially aligned with longitudinal axis 101 of vacuum housing 70.

Seal plate 135 may be pivoted on hinge 137 to a closed position such that seal plate is parallel to and communicates with housing flange 100. When the seal plate is closed and a vacuum is drawn through the apparatus 10, the seal plate seals off the housing's open face 75 and only allows air to flow into the vacuum housing and associated vacuum bag 117 through orifice 136.

The vacuum bag 117 used in the preferred embodiment comprises a rigid cardboard panel 150 covering the open end of bag 117 and is of a conventional construction. The cardboard panel includes an orifice 152 similar in size and position to orifice 136 in seal plate 135 such that bag orifice coaxially aligns with orifice 136. The cardboard panel further includes a bag flange 155 that, when installed, lays flat against the housing flange 100 to prevent bag 117 from sliding too far into the vacuum bag cage 115. Accordingly, when the seal plate is in the closed position, the cardboard flange is sandwiched between the seal plate and the housing flange.

In the preferred embodiment, the seal plate 135 has a rectangular shape and is sized to just overlap the housing flange 100 when in a closed position. A latch 160 coupled to seal plate is used to hold the seal plate in the closed position, thus covering the open end 75 of the vacuum housing 70.

A cover panel 140 attaches to a cover plate hinge 142 which is in turn coupled to the housing flange 100. The cover plate hinge fastens to housing flange 100 such as by spot welds or threaded fasteners 143. The cover plate may be pivoted about the hinge to the open position, thereby exposing seal plate 137 and orifice 136. In the closed position, the cover plate covers the housing flange and seal plate. A latch 145 holds the cover plate in a closed position. A handle 146 is provided to move the cover plate between the open and closed positions. A bevel edge 147 around the cover plate shields the housing flange and seal plate from view when closed.

Figures 5A, 5B:
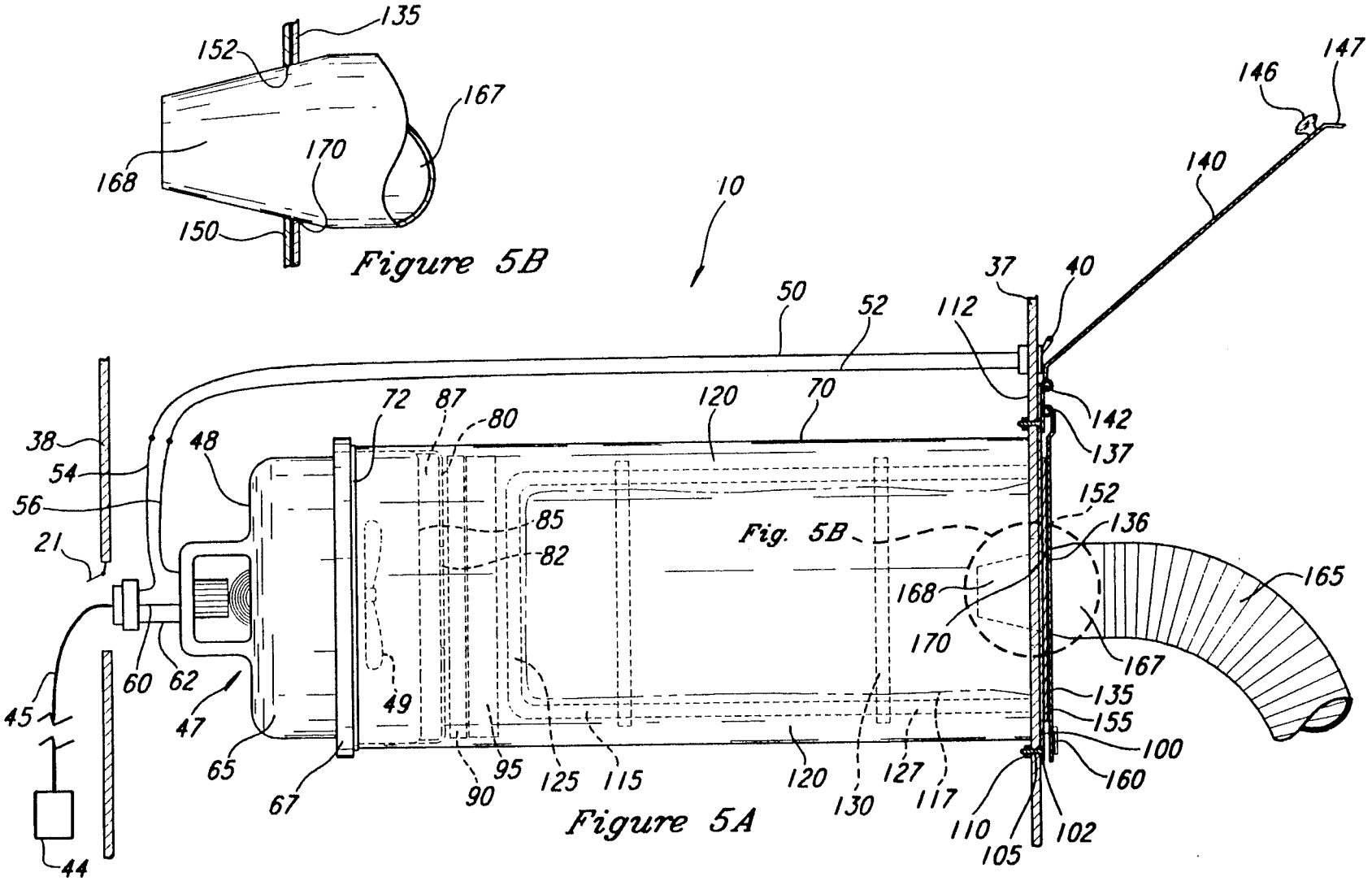
FIG. 5A is a top view of the vacuum apparatus in a stove housing with a vacuum hose attached.
FIG. 5B is a fragmentary view of the vacuum hose and vacuum apparatus interface.

Referring now to FIGS. 5A and 5B, the vacuum hose nozzle 167 communicates with the vacuum apparatus 10 by a press-fit into the orifice 136. In the preferred embodiment, the nozzle is rubberized and tapered to form a seal with the seal plate 137. The nozzle also slides into and seals with vacuum bag orifice 152. Accordingly, when the vacuum motor 47 is activated by switch 40, the air is drawn through the vacuum hose, thereby enabling the transfer of debris from the stove combustion chamber 17 or surrounding area into the vacuum bag.

In order to insert hose 165 into orifice 136, cover plate 140 must be pivoted to the open position, thereby exposing the seal plate 135 and orifice 136.

Once installed within the wood-burning stove unit 15, the vacuum apparatus 10 may be used to vacuum debris from the combustion chamber 17 and the surrounding areas by opening the cover plate 140, inserting the nozzle into the orifice 136 of the seal plate 135, activating the motor 47 by switching the activating switch 42 from an off position to an on position, and passing the vacuum hose 167 over a desired area to transfer debris from the desired area into the vacuum bag 117. After finishing, the vacuum motor is deactivated, the vacuum hose 165 is removed and the cover is closed.

The above-described vacuum apparatus and the dimensional characteristics thereof may be altered as needed to achieve an apparatus that will fit in a wide variety of different wood stove units.

Referring back to FIGS. 1 and 2, installation of the vacuum apparatus, either on a retrofit basis or during the stove manufacture process, may be accomplished by cutting the first orifice 21 in the back panel 38 of pedestal 20, and cutting the orifices 42 and 43 in the front panel 37. The electric cord 45 is fed through the first orifice 21 and is connected to the on/off switch 40 and the vacuum motor 47, as described above.

The vacuum apparatus 10 is inserted in pedestal 20 through the third orifice 43 such that seal plate 135 engages the front panel 37. The vacuum housing flange 100 is fastened to front panel 37, thereby fastening vacuum housing 70 in a cantilevered position extending into the pedestal 20 from the front panel 37.

When vacuum apparatus 10 is securely fastened and installed in pedestal 20, cover plate 140 may be opened, thereby exposing seal plate 135. Then the seal plate may be opened, thereby exposing removable vacuum bag cage 115, and the vacuum bag 117 is installed in vacuum bag cage. Installation is completed upon closing seal plate to cover the open end 75 and the vacuum bag and upon closing the cover plate to cover the seal plate.

Obviously, numerous modifications and variations of the stove-mounted vacuum apparatus disclosed herein will occur to those skilled in the art in view of this disclosure. Therefore, it is expressly to be understood that these modifications and variations, and the equivalents thereof, may be practiced while remaining within the spirit and scope of the invention as defined in the following claims.

I claim:

1. A stove for burning combustible materials in combination with a vacuum apparatus comprising:

a stove having a combustion chamber for burning materials leaving residue from combusted materials; and a vacuum system having vacuum apparatus including a vacuum motor and vacuum bag located on said stove for removing the residue from the combustion chamber.

2. The invention of claim 1, the stove further comprising a housing joined to the combustion chamber; the vacuum apparatus located within the housing, and further comprising a vacuum hose for transferring the residue from the combustion chamber to the vacuum apparatus.

3. The vacuum and stove combination of claim 2 wherein the stove is a pellet stove.

4. The vacuum and stove combination of claim 2 wherein the hosing is a pedestal located below and supporting the combustion chamber.

5. A vacuum apparatus disposed for use in a free-standing wood-burning stove unit, the apparatus comprising:

a vacuum housing comprising an open end and a housing flange around the open end;

a vacuum motor coupled to the vacuum housing, the vacuum motor coupled to a power source;

a removable cage shaped to receive a vacuum bag, the cage further shaped to fit within the vacuum housing and to maintain air flow around the vacuum bag;

a seal plate coupled to the vacuum housing, the seal plate further comprising an orifice shaped to receive a vacuum hose;

fastening means for mounting the vacuum housing onto a free-standing wood-burning stove unit;

a vacuum activating means coupled to the vacuum motor and the power source to activate the vacuum motor; and a vacuum hose comprising an attachment means shaped to communicate with the orifice in the seal plate.

6. A wood-burning stove apparatus with an integral vacuum system, the apparatus comprising;

a stove housing, the stove housing comprising a front face and a back face; and a vacuum apparatus disposed in the stove housing, the vacuum apparatus comprising:

a vacuum housing comprising an open end, a housing flange around the open end, the flange coupled to the front face of the pedestal;

a vacuum motor coupled to the vacuum housing and to a power source, a removable cage shaped to receive a vacuum bag, the cage further shaped to fit into the vacuum housing and to maintain air flow around the vacuum bag;

fastening means to fasten the vacuum housing to the front face of the pedestal;

a seal plate coupled to the vacuum housing, the seal plate further comprising an orifice shaped to receive a vacuum hose;

a vacuum activating means coupled to the vacuum motor and to the power source to activate the vacuum motor; and a vacuum hose comprising attachment means shaped to communicate with the orifice in the seal plate.

7. The apparatus of claim 6, the stove housing further comprising a pedestal with the vacuum apparatus further comprising a seal between the vacuum motor and the vacuum housing, a screen within the housing adjacent to the vacuum motor, and an air filter within the housing adjacent to the screen.

8. The apparatus of claim 7, the vacuum apparatus further comprising:

a seal plate hinge attached to the seal plate and to the housing flange;

a cover plate hinge attached to a cover plate and to the housing flange;

a first latch coupled to the seal plate to secure the seal plate in a closed position;

a second latch coupled to the cover plate to secure the cover plate in a closed position; and a cover handle attached to the cover plate.

9. A wood-burning stove apparatus with an integral vacuum system, the apparatus comprising:

stove housing means surrounding a combustion chamber, the stove housing means further comprising a front face; and vacuum means disposed in the stove housing means, the vacuum apparatus comprising:

a vacuum housing means comprising an open end, a housing flange around the open end, the flange coupled to the front face of the stove housing;

vacuum generating means coupled to the vacuum housing means and to a power source;

removable vacuum bag receiving means, the receiving means further shaped to fit into the vacuum housing means and to maintain air flow around the vacuum bag;

fastening means to fasten the vacuum housing means to the front face of the stove housing means;

seal means coupled to the vacuum housing means to seal said open end, the seal means further comprising vacuum hose receiving means;

vacuum activating means coupled to the vacuum motor and to the power source to activate the vacuum motor; and a vacuum hose comprising attachment means shaped to communicate with the vacuum hose receiving means in the seal plate.

10. The apparatus of claim 9, the vacuum means further comprising filtering means to filter debris from the air flow outside of the vacuum bag.

11. A method of installing a vacuum apparatus in a housing of a wood-burning stove unit, the stove housing having a front panel and back panel, the steps comprising:

cutting a first orifice in the back panel;

cutting a second orifice in the front panel;

cutting a third orifice in the front panel;

positioning an electrical cord through the first orifice, the electrical cord comprising electrical wires therein;

connecting the electrical wires to an on/off switch and to a vacuum motor in the vacuum apparatus such that the on/off switch controls power to the vacuum motor;

installing the on/off switch in the second orifice and securing the switch to the front panel;

inserting the vacuum apparatus in the stove housing through the third orifice, the vacuum apparatus comprising:

a vacuum housing comprising an open end, a housing flange around the open end, the flange coupled to the front face of the stove housing;

a vacuum motor coupled to the vacuum housing, the vacuum motor coupled to a power source through the electrical cord;

a removable cage shaped to receive a vacuum bag, the cage further shaped to fit into the vacuum housing and to maintain air flow around the vacuum bag;

fastening means to fasten the vacuum housing to the front panel of the stove housing;

a seal plate coupled to the vacuum housing, the seal plate further comprising an orifice shaped to receive a vacuum hose;

a cover plate coupled to the vacuum housing, the cover plate shaped to cover the seal plate;

the on/off switch coupled to the vacuum motor and to the power source to activate the vacuum motor; and a vacuum hose comprising an attachment means shaped to communicate with the orifice in the seal plate; and fastening with the fastening means the housing flange to the front panel of the stove housing.

12. The method of claim 11, the steps of inserting and installing the vacuum apparatus further comprising opening the cover plate thereby exposing the seal plate, opening the seal plate thereby exposing the removable cage and the open end of the vacuum housing, installing the vacuum bag in the cage, closing the seal plate thereby covering the open end and the vacuum bag, and closing the cover plate thereby covering the seal plate; and the step of fastening with the fastening means the housing flange to the front panel of the stove housing further comprising fastening the housing flange to the front panel such that the housing flange rests flush against the front panel and the vacuum housing extends into the stove housing.

13. A vacuum apparatus disposed in a wood-burning stove unit, the apparatus comprising:

a vacuum housing comprising an open end and a housing flange around the open end;

a vacuum motor having a motor housing with an annular stop ring that communicates with the vacuum housing, the vacuum motor coupled to the vacuum housing and to a power source;

a removable cage shaped to receive a vacuum bag, the cage further shaped to fit within the vacuum housing and to maintain air flow around the vacuum bag;

a seal plate coupled to the vacuum housing, the seal plate further comprising an orifice shaped to receive a vacuum hose, a hinge connected to the housing flange, and a clasp to hold the seal plate in a closed position over the open end;

fastening means to fasten the vacuum housing to a wood-burning stove unit;

a vacuum activating means coupled to the vacuum motor and the power source to activate the vacuum motor;

a vacuum hose comprising an attachment means shaped to communicate with the orifice in the seal plate;

a screen mounted within the vacuum housing adjacent to the vacuum motor;

an air filter mounted within the vacuum housing adjacent to the screen; and a seal between the stop ring and the vacuum housing.

* * * * *